US010608379B1

(12) United States Patent
Shen et al.

(10) Patent No.: US 10,608,379 B1
(45) Date of Patent: Mar. 31, 2020

(54) CRIMP CRYSTAL HEAD

(71) Applicant: Wuxi Universal Network Corporation Co., Ltd, Wuxi (CN)

(72) Inventors: Sheng-Cheng Shen, Wuxi (CN); Qing Chen, Wuxi (CN); Jiajia Yao, Wuxi (CN)

(73) Assignee: WUXI UNIVERSAL NETWORK CORPORATION CO., LTD, Wuxi (CN)

( * ) Notice: Subject to any disclaimer, the term of this patent is extended or adjusted under 35 U.S.C. 154(b) by 0 days.

(21) Appl. No.: 16/449,341

(22) Filed: Jun. 22, 2019

(51) Int. Cl.

| | |
|---|---|
| ***H01R 13/6463*** | (2011.01) |
| ***H01R 13/641*** | (2006.01) |
| ***H01R 13/66*** | (2006.01) |
| ***H01R 4/18*** | (2006.01) |
| ***H01R 43/048*** | (2006.01) |
| ***H01R 13/502*** | (2006.01) |
| ***H01R 24/64*** | (2011.01) |
| ***H01R 13/648*** | (2006.01) |

(52) U.S. Cl.
CPC ..... *H01R 13/6463* (2013.01); *H01R 4/18* (2013.01); *H01R 13/502* (2013.01); *H01R 13/641* (2013.01); *H01R 13/648* (2013.01); *H01R 13/66* (2013.01); *H01R 24/64* (2013.01); *H01R 43/048* (2013.01)

(58) Field of Classification Search
CPC ..... H01R 13/6463; H01R 13/502; H01R 13/641; H01R 13/648; H01R 13/66; H01R 4/18; H01R 24/64; H01R 43/048
See application file for complete search history.

(56) References Cited

U.S. PATENT DOCUMENTS

| | | | | |
|---|---|---|---|---|
| 3,954,320 A * | 5/1976 | Hardesty | H01R 24/62 | 439/418 |
| 4,424,403 A * | 1/1984 | Bogese, II | H01B 7/0823 | 174/106 SC |
| 4,516,825 A * | 5/1985 | Brennan | H01R 13/6581 | 439/422 |
| 5,562,475 A * | 10/1996 | Kern, Jr. | H01R 13/6272 | 439/344 |
| 5,772,465 A * | 6/1998 | Hwang | H01R 9/035 | 439/101 |

(Continued)

*Primary Examiner* — Abdullah A Riyami
*Assistant Examiner* — Nader J Alhawamdeh
(74) *Attorney, Agent, or Firm* — Chun-Ming Shih; HDLS IPR Services

(57) ABSTRACT

A crimp crystal head includes a base, golden plates, a circuit board, crimping terminals and a fixing seat. The base has insertion slots. The golden plates are separately placed in the insertion slots. The circuit board is disposed in the base. Two ends of the circuit board connect to the golden plates and have terminal holes, respectively. Each crimping terminal has a wiring hole for being inserted by a twisted pair wire and a crimping trough for fixing and connecting the twisted pair wire. The wiring hole communicates with the crimping trough. Each crimping terminal has a fixing bar inserted into the terminal hole with interference fit. The fixing seat is installed on the circuit board and has terminal trenches and inserting holes separately communicating with the terminal trenches. The crimping terminal is inserted into the terminal trench. The insertion hole is inserted by the twisted pair wire.

10 Claims, 8 Drawing Sheets

(56) References Cited

U.S. PATENT DOCUMENTS 6,162,077 A * 12/2000 Laes ..... H01R 13/7032
439/188
6,290,532 B1 * 9/2001 Vermeersch ..... H05K 3/301
439/460

* cited by examiner

CRIMP CRYSTAL HEAD

BACKGROUND OF THE INVENTION

Technical Field

The invention relates to crystal heads, particularly to crimp crystal heads.

Related Art

A current crystal head uses golden plates to press a twisted pair wire and make an electric connection therewith. Because of the limitation of size of crystal heads, the insertion holes for inserting twisted pair wires are very small. Also, the twisted pair wires must be arranged in a specific order in a row and ends of the twisted pair wires must be flush with each other. As a result, the twisted pair wires to be inserted are easy to vary in position. Once one condition is missed, the insertion operation must be implemented again. A crystal head with twisted pair wires inserted correctly can be pressed by a crimping pliers to crimp the golden plates to contact the twisted pair wires. As a result, installing a crystal head is laborious and time consuming.

SUMMARY OF THE INVENTION

To overcome the abovementioned problems, the invention provides a crimp crystal head which can be easily and rapidly assembled with twisted pair wires.

The invention provides a crimp crystal head which includes: a base having multiple insertion slots; golden plates, separately placed in the insertion slots; a circuit board, disposed in a chamber of the base, an end of the circuit board connecting to the golden plates, and another end of the circuit board having terminal holes; crimping terminals, each being formed with a wiring hole for being inserted by a twisted pair wire and a crimping trough for fixing and electrically connecting the twisted pair wire, the wiring hole communicating with the crimping trough, an end of each of the crimping terminals being formed with a fixing bar inserted into one of the terminal holes, and both the fixing bar and the terminal hole being an interference fit; and a fixing seat, installed at the another end of the circuit board, having terminal trenches and inserting holes separately communicating with the terminal trenches, the crimping terminal being inserted into the terminal trench, and the insertion hole being used for being inserted by the twisted pair wire.

The invention changes an inserting position of twisted pair wires to the fixing seat with larger inserting holes for easy insertion. Larger wiring holes are provided for easily inserting twisted pair wires. When twisted pair wires have been inserted, press down the crimping terminals to make the fixing bars inserted into and fixed in the terminal holes. The twisted pair wires are placed in the crimping troughs so that the shields of the twisted pair wires are broken by the crimping troughs to make electric connection between the twisted pair wires and the crimping troughs. The twisted pair wires can be fixed in the crimping troughs because the crimping trough is smaller than a diameter of the twisted pair wire.

The twisted pair wires are not in direct contact with the golden plates, so the requirement of insertion is relatively low. All users need to do is to correctly insert twisted pair wires into corresponding wiring holes and inserting holes, and both arranging wires and flushing ends of wires are not required any more. This makes installing a crystal head easy, simple, labor saving and time saving.

Preferably, two sides of the crimping trough of the crimping terminal is formed with placement slopes.

As a result, the placement slopes can decrease a contact area between the crimping trough and a twisted pair wire to promote the wire to be jammed in the crimping trough. Also, a shield of the twisted pair wire is easy to be broken to make an electric connection between the crimping terminal and a copper core of the twisted pair wire.

Preferably, the fixing bar is formed with a flexible hole.

As a result, the flexible hole can enhance flexibility of the fixing bar to make the fixing bars easy to be inserted into the terminal holes. Also, the fixing bars can be tightly jammed in the terminal holes with certain flexibility to increase reliability of connection between the fixing bars and the terminal holes.

Preferably, the flexible hole is oval and the fixing bar is oval.

As a result, the oval fixing bar can maintain better flexibility and tends to be deformed.

Preferably, the terminal holes are arranged in two parallel rows, the crimping terminals are separately inserted into the two rows of terminal holes, the two rows of terminal terminals are located two opposite sides of the circuit, and the terminal trenches and the inserting holes are located at a top and a bottom of the fixing seat, respectively.

As a result, the arrangement of two rows of the crimping terminals can shorten a width of the fixing seat 5 to make the structure compact and easy to be inserted by twisted pair wires.

Preferably, an order of a row of the inserting holes is 1, 2, 4 and 5, an order of another row of the inserting holes is 3, 6, 7 and 8, wires Nos. 1 and 3 are in a column, wires Nos. 2 and 6 are in a column, wires Nos. 4 and 7 are in a column, and wires Nos. 5 and 8 are in a column.

As a result, wires Nos. 4 and 5 are located away from wires Nos. 3 and 6 to increase distance therebetween. This can effectively reduce interference.

Preferably, an end portion of each of the inserting holes is formed with a guiding slope.

As a result, the guiding slope can guide a wire to be inserted.

Preferably, the fixing seat is formed with a connecting trough for being inserted by the circuit board, and the connecting trough communicates with the terminal trenches.

As a result, the connecting trough is used to fix the circuit board.

Preferably, an end of the circuit board is formed with connecting holes, an end of the golden plate is provided with a connecting bar inserted into the connecting hole, and both the connecting bar and the connecting hole are an interference fit.

As a result, the connecting bar is easy to be connected with the circuit board to make the structure simple.

Preferably, the connecting bar is formed with a flexible hole.

As a result, the flexible hole can enhance flexibility of the connecting bar to make the connecting bars easy to be inserted into the connecting holes. Also, the connecting bar can be tightly pressed in the connecting hole with certain flexibility to increase reliability of connection between the connecting bar and the connecting hole.

Preferably, the invention further includes a metal shielding case covering both the fixing seat and the base, an outside of the base is formed with a recess for receiving the metal shielding case.

As a result, the metal shielding case functions as a shield for expanding applications of the crystal head. The metal shielding case received in the recess avoids increase of size of the base.

The crimp crystal head of the invention has a simple structure, easy installation, rapid and reliable connection and great anti-interference ability. Also, the shielding function can be increased.

DETAILED DESCRIPTION OF THE INVENTION

Embodiment 1

Figure 1:
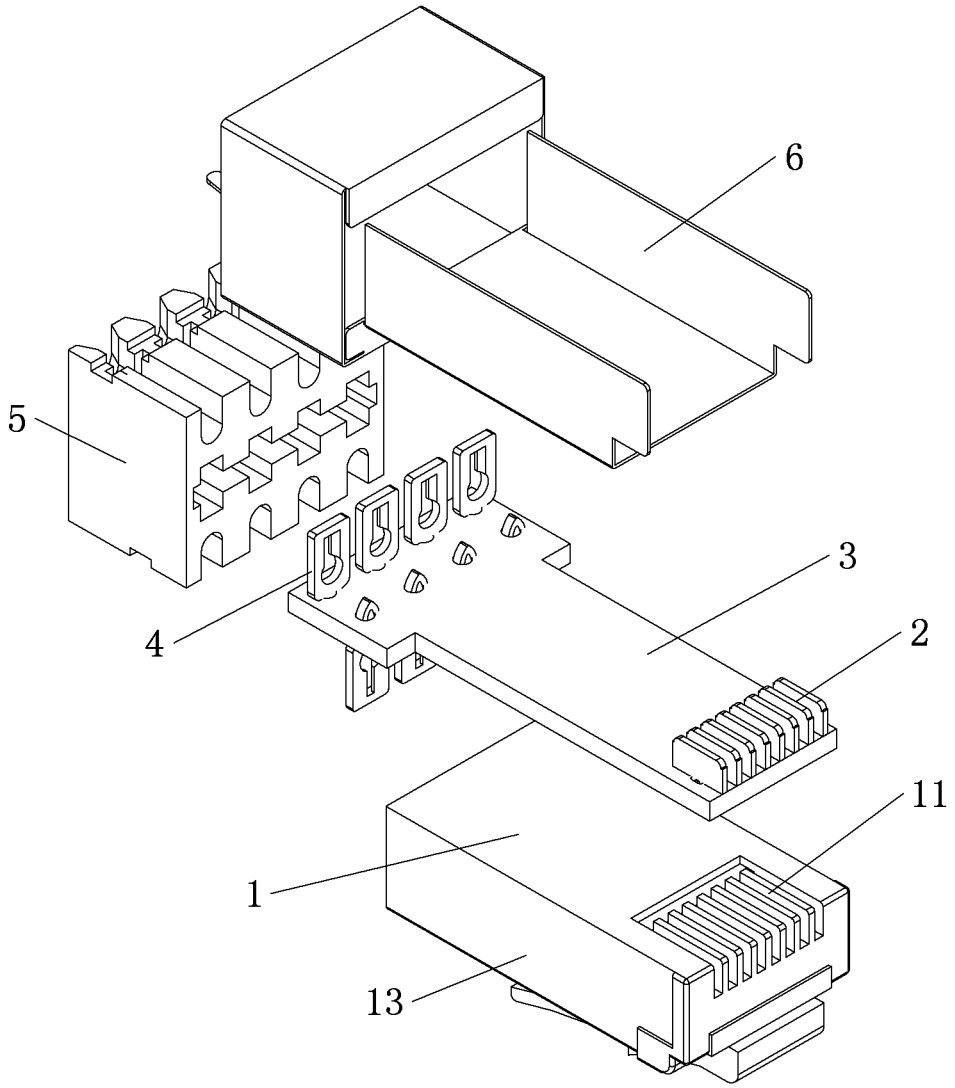
FIG. 1 is an exploded view of the invention.
Figure 2:
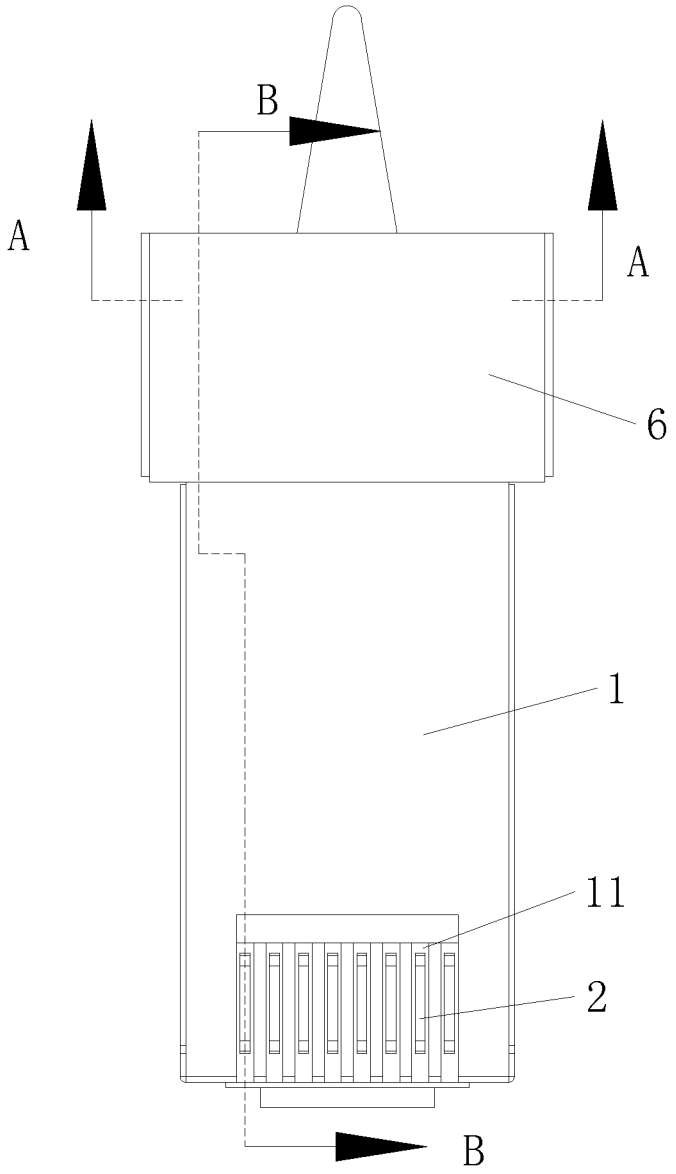
FIG. 2 is a top view of the invention.
Figure 3:
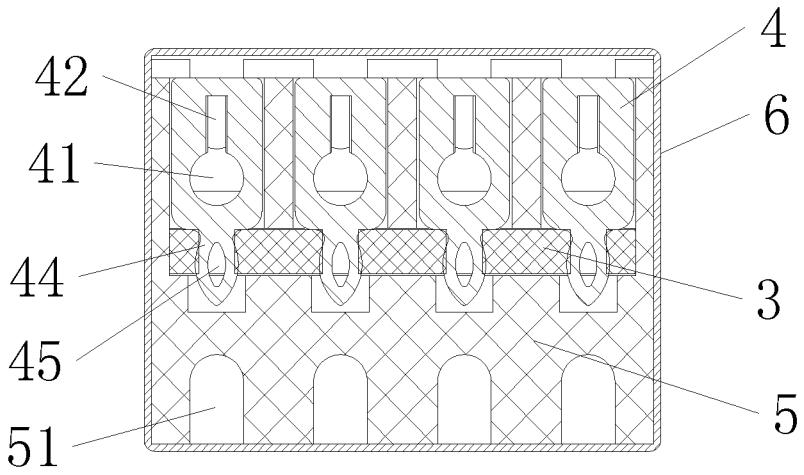
FIG. 3 is a cross-section view along line A-A in FIG. 2.
Figure 4:
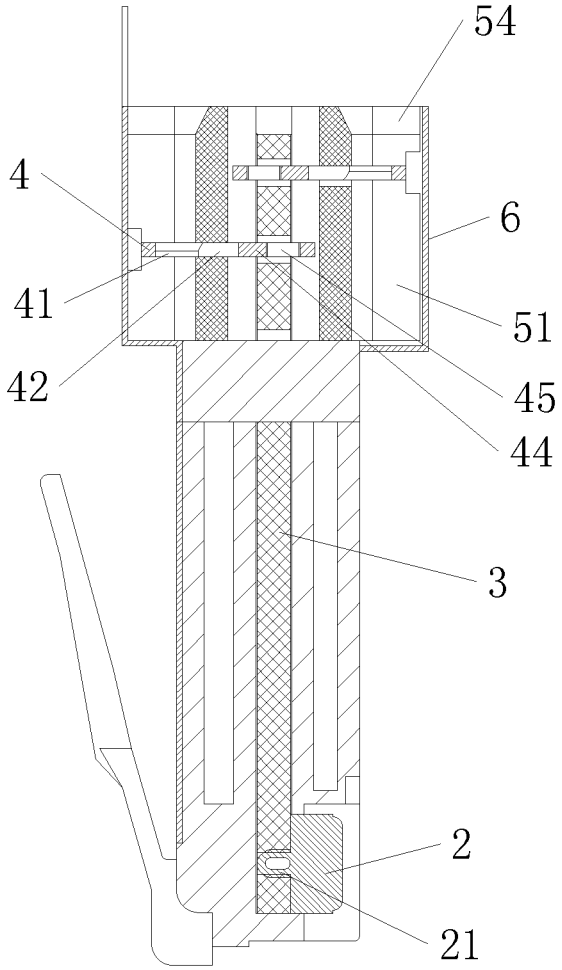
FIG. 4 is a cross-section view along line B-B in FIG. 2.
Figure 5:
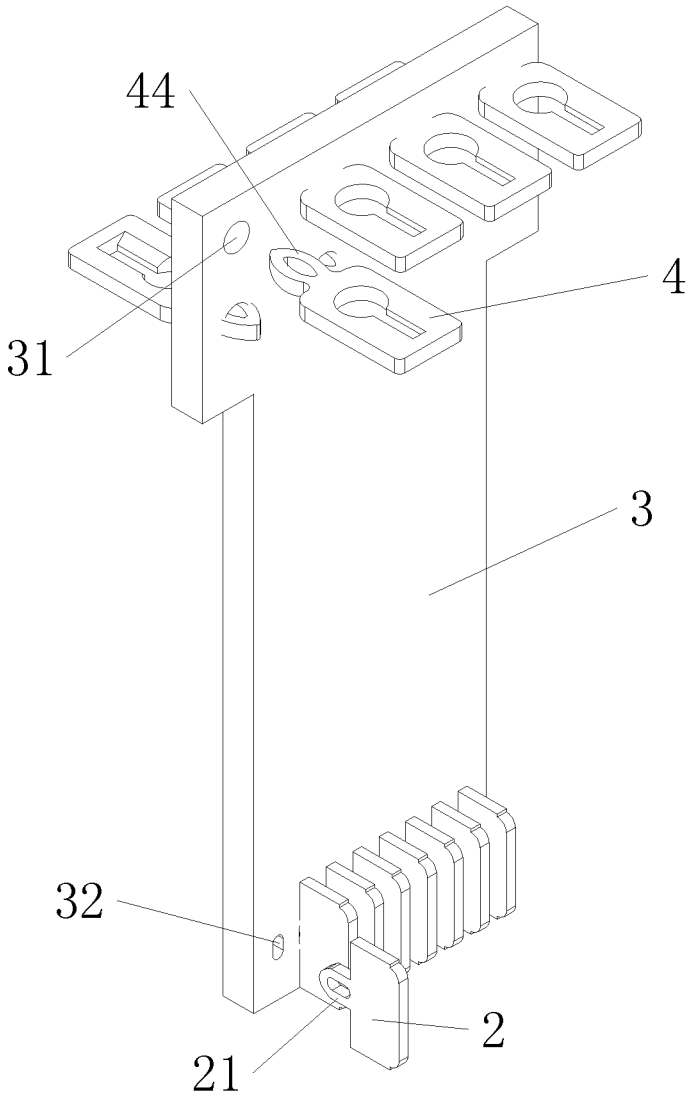
FIG. 5 is a schematic view of assembling of the circuit board, the golden plates and the crimping terminals.

Please refer to FIGS. 1-11. A crimp crystal head includes a base 1 having multiple insertion slots 11; golden plates 2, separately placed in the insertion slots 11; a circuit board 3, disposed in a chamber of the base 1, an end of the circuit board 3 connecting to the golden plates 2, and another end of the circuit board 3 having terminal holes 31; crimping terminals 4, each being formed with a wiring hole 42 for being inserted by a twisted pair wire and a crimping trough 41 for fixing and electrically connecting the twisted pair wire, the wiring hole 42 communicating with the crimping trough 41, an end of each crimping terminal 4 being formed with a fixing bar 44 inserted into one of the terminal holes 31, and both the fixing bar 44 and the terminal hole 31 being an interference fit; and a fixing seat 5, installed at the another end of the circuit board 3, having terminal trenches 52 and inserting holes 51 separately communicating with the terminal trenches 52, the crimping terminal 4 being movably inserted into the terminal trench 52, and the insertion hole 51 being used for being inserted by the twisted pair wire.

The invention changes an inserting position of twisted pair wires to the fixing seat 5 with larger inserting holes 51 for easy insertion. Larger wiring holes 42 are provided for easily inserting twisted pair wires. When twisted pair wires have been inserted, press down the crimping terminals 4 to make the fixing bars 44 inserted into and fixed in the terminal holes 31. The twisted pair wires are placed in the crimping troughs 41 so that the shields of the twisted pair wires are broken by the crimping troughs 41 to make electric connection between the twisted pair wires and the crimping troughs 41. The twisted pair wires can be fixed in the crimping troughs 41 because the crimping trough is smaller than a diameter of the twisted pair wire. The wiring hole 42 is larger than the twisted pair wire in diameter.

The twisted pair wires are not in direct contact with the golden plates 2, so the requirement of insertion is relatively low. All users need to do is to correctly insert twisted pair wires into corresponding wiring holes 42 and inserting holes 51, and both arranging wires and flushing ends of wires are not required any more. This makes installing a crystal head easy, simple, labor saving and time saving.

In detail, the insertion slots 11 are eight or two in number, eight and two are used for network cables and telephone cables, respectively. The golden plates 2 are the same as the insertion slots 11 in number.

Figure 6:
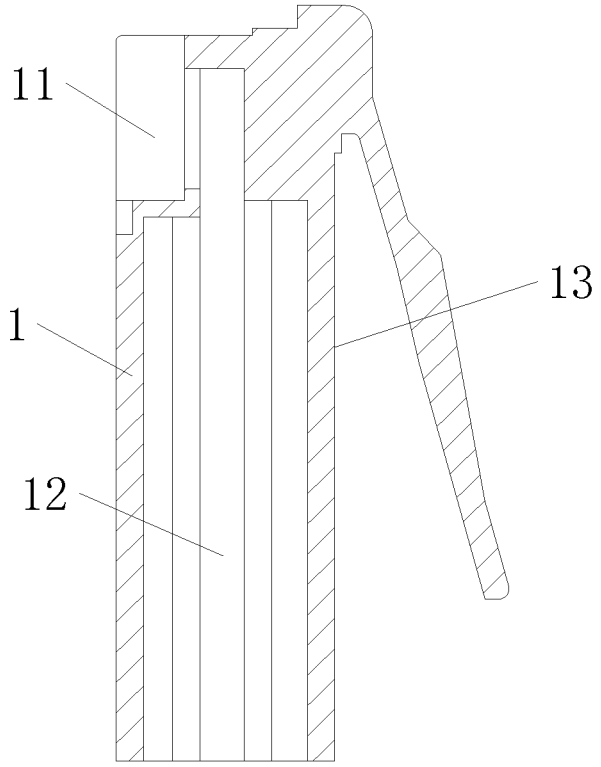
FIG. 6 is a cross-section view of the base.
Figure 7:
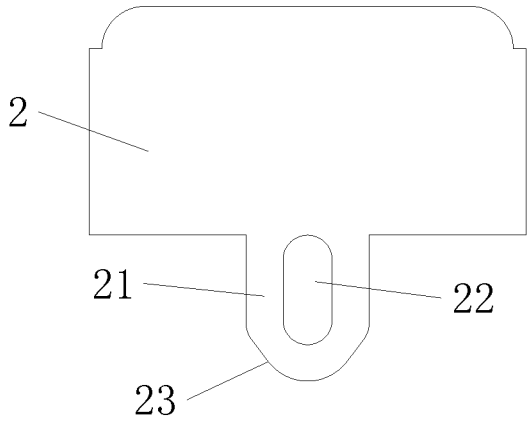
FIG. 7 is schematic view of the golden plate.

As shown in FIG. 6, the base 1 is formed with a positioning trough 12 for receiving and fixing the circuit board 3. The positioning trough 12 communicates with the insertion slots 11.

The base 1 is further provided with an anti-release button.

Figure 8:
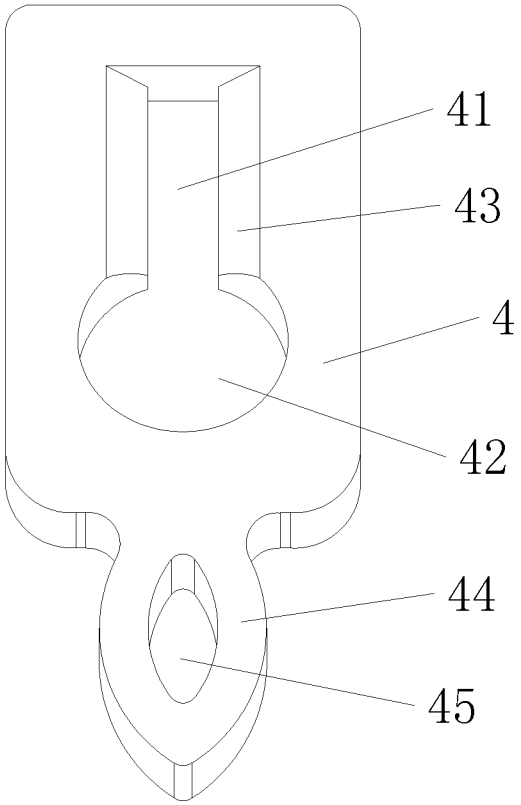
FIG. 8 is a schematic of the crimping terminal.

As shown in FIG. 8, the crimping terminals 4 are made of copper. The fixing bar 44 is an oval shape. The fixing bar 44 is formed with a flexible hole 45 which is oval.

The hollow oval fixing bar 44 can maintain better flexibility and tends to be deformed. The flexible hole 45 can enhance flexibility of the fixing bar 44 to make the fixing bars 44 easy to be inserted into the terminal holes 31. Also, the fixing bars 44 can be tightly jammed in the terminal holes 31 with certain flexibility to increase reliability of connection between the fixing bars 44 and the terminal holes 31.

The terminal hole 31 is of a circular shape and copper-plated. The fixing bars 44 and the copper plate implement an electric connection.

As shown in FIGS. 1, 3, 4 and 5, the terminal holes 31 are arranged in two parallel rows. The crimping terminals 4 are separately inserted into the two rows of terminal holes 31. The two rows of terminal terminals 4 are located two opposite sides of the circuit 3. The terminal trenches 52 and the inserting holes 51 are located at the top and the bottom of the fixing seat 5, respectively.

The arrangement of two rows of the crimping terminals can shorten a width of the fixing seat 5 and easy to be inserted by twisted pair wires.

Further, an end portion of each of the inserting holes 51 is formed with a guiding slope 54 for introducing wires to insert.

Figure 9:
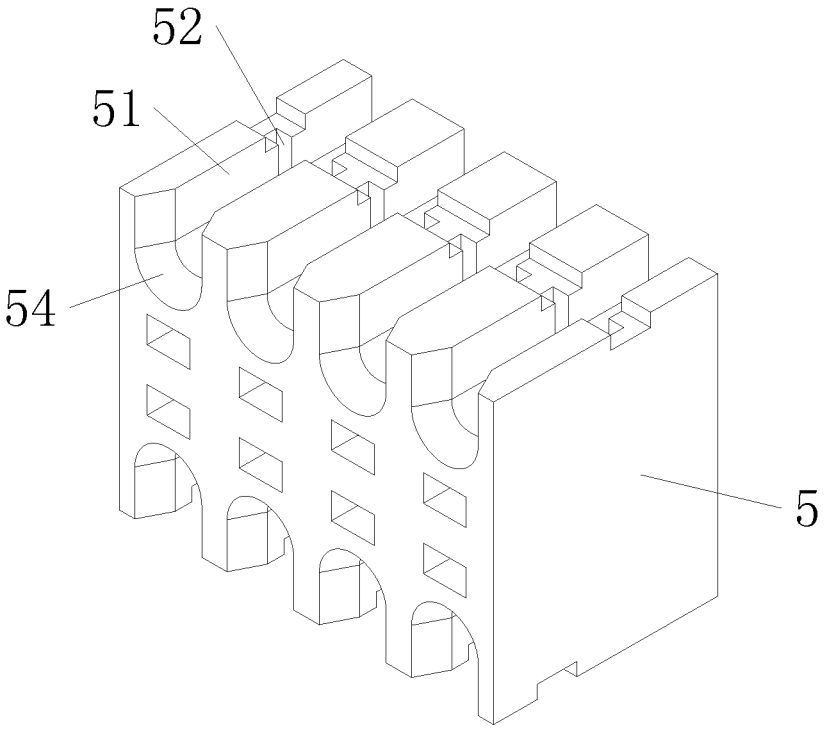
FIG. 9 is a schematic view of the fixing seat.
Figure 10:
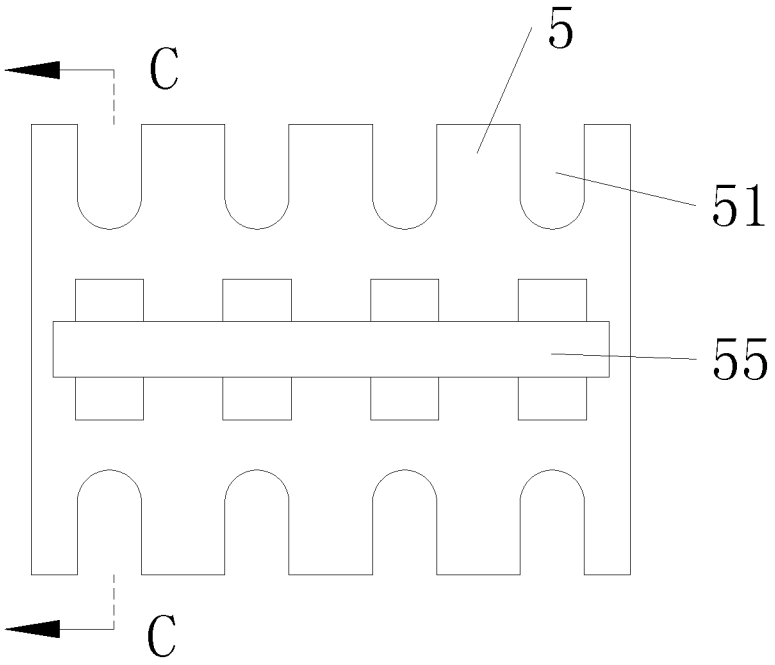
FIG. 10 is a bottom view of the fixing seat.
Figure 11:
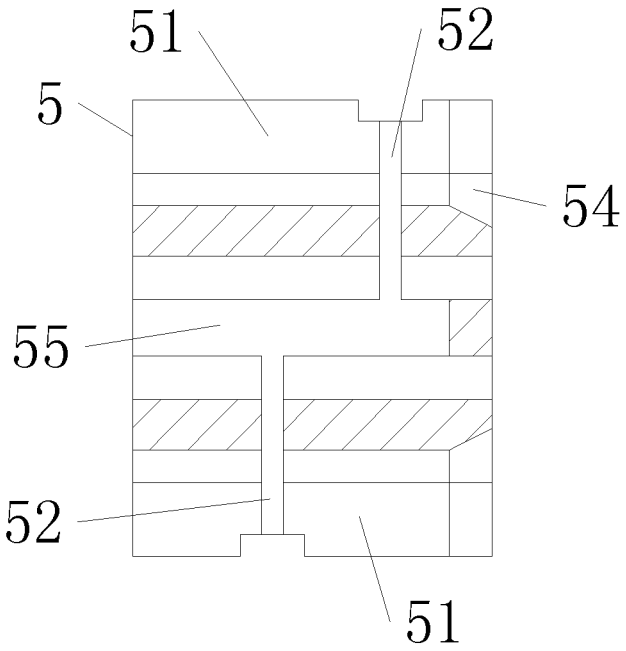
FIG. 11 is a cross-section view along line C-C in FIG. 10.

As shown in FIGS. 9-11, the fixing seat 5 is formed with a connecting trough 55 for being inserted by the circuit board 3. The connecting trough 55 communicates with the terminal trenches 52. The connecting trough 55 positions the fixing seat 5 to secure a relative position between the fixing seat 5, the base 1 and the circuit board 3.

An end of the circuit board 3 is formed with connecting holes 32. The connecting holes 32 is in accordance with the golden plates 2 in number. An end of the golden plate 2 is provided with a connecting bar 21 inserted into the connecting hole 32. Both the connecting bar 21 and the connecting hole 32 are an interference fit. The connecting bar 21 makes the golden plate 2 connect with the circuit board 3 for structural simplification.

The connecting bar 21 has a round end 23 for introducing the connecting bar 21 to be inserted into the connecting hole 32.

The connecting hole 32 is copper-plated. The connecting bar 21 and the copper plate of the connecting hole 32 implement an electric connection. The circuit board 3 is provided with wires separately electrically connecting to the fixing hole to make an electric connection between the golden plates 2 and the crimping terminals 4.

The connecting bar 21 is of a rectangular shape. The end portion of the connecting bar 21 is of a round shape. The connecting hole 32 is kidney-shaped. The cooperation between the kidney-shaped connecting hole 32 and the rectangular connecting bar 21 can guarantee a reliable connection between the connecting bar 21 and the connecting hole 32 and limit a position of the golden plate 2 to avoid shake of the golden plate 2.

The connecting bar 21 is formed with a flexible hole 22. The flexible hole 22 can enhance flexibility of the connecting bar 21 to make the connecting bars 21 easy to be inserted into the connecting holes 32. Also, the connecting bar 21 can be tightly pressed in the connecting hole 32 with certain flexibility to increase reliability of connection between the connecting bar 21 and the connecting hole 32.

When installing the crystal head, insert twisted pair wires separately into the wiring holes 42 of the crimping terminal 4 through the inserting holes 51 of the fixing seat 5. After all the twisted pair wires have been inserted, press down the crimping terminals to make the fixing bars inserted into and fixed in the terminal holes. The twisted pair wires are placed in the crimping troughs 41 so that the shields of the twisted pair wires are broken by the crimping troughs 41 to make electric connection between the twisted pair wires and the crimping troughs 41. The twisted pair wires are fixed in the crimping troughs 41. Thus, installation of the crystal head is completed.

Embodiment 2

Besides the above embodiment, the invention further includes a metal shielding case 6 covering both the fixing seat 5 and the base 1. The outside of the base 1 is formed with a recess 13 for receiving the metal shielding case 6.

The metal shielding case 6 functions as a shield for expanding applications of the crystal head. The metal shielding case 6 received in the recess 13 avoids increase of size of the base 1.

Embodiment 3

Figure 12:
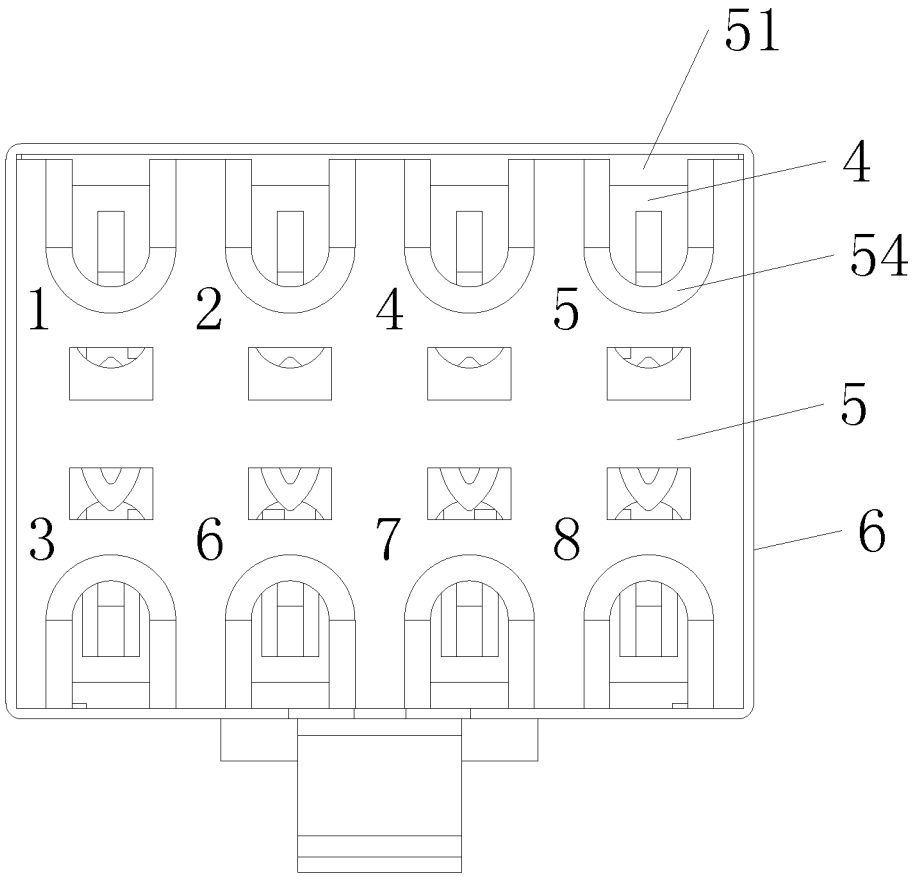
FIG. 12 is a schematic view showing the wiring order of the invention.

Besides the above embodiments, as shown in FIG. 12, the order of a row of the inserting holes 51 is 1, 2, 4 and 5, and the order of the other row of the inserting holes 51 is 3, 6, 7 and 8. Wires Nos. 1 and 3 are in a column, wires Nos. 2 and 6 are in a column, wires Nos. 4 and 7 are in a column, and wires Nos. 5 and 8 are in a column. Wires Nos. 4 and 5 are located away from wires Nos. 3 and 6 to increase distance therebetween. This can effectively reduce interference and increase ability of anti-interference.

Wiring standard of the crystal head is T568B/A.

What is claimed is:

1. A crimp crystal head comprising:

a base having multiple insertion slots;

golden plates, separately placed in the insertion slots;

a circuit board, disposed in a chamber of the base, an end of the circuit board connecting to the golden plates, and another end of the circuit board having terminal holes;

crimping terminals, each being formed with a wiring hole for being inserted by a twisted pair wire and a crimping trough for fixing and electrically connecting the twisted pair wire, the wiring hole communicating with the crimping trough, an end of each of the crimping terminals being formed with a fixing bar inserted into one of the terminal holes, and both the fixing bar and the terminal hole being an interference fit; and a fixing seat, installed at the another end of the circuit board, having terminal trenches and inserting holes separately communicating with the terminal trenches, the crimping terminal being inserted into the terminal trench, and the insertion hole being used for being inserted by the twisted pair wire.

2. The crimp crystal head of claim 1, wherein two sides of the crimping trough of the crimping terminal is formed with placement slopes.

3. The crimp crystal head of claim 1, wherein the fixing bar is formed with a flexible hole which is oval, and the fixing bar is oval.

4. The crimp crystal head of claim 1, wherein the terminal holes are arranged in two parallel rows, the crimping terminals are separately inserted into the two rows of terminal holes, the two rows of terminal terminals are located two opposite sides of the circuit, and the terminal trenches and the inserting holes are located at a top and a bottom of the fixing seat, respectively.

5. The crimp crystal head of claim 4, wherein an order of a row of the inserting holes is 1, 2, 4 and 5, an order of another row of the inserting holes is 3, 6, 7 and 8, wires Nos. 1 and 3 are in a column, wires Nos. 2 and 6 are in a column, wires Nos. 4 and 7 are in a column, and wires Nos. 5 and 8 are in a column.

6. The crimp crystal head of claim 1, wherein an end portion of each of the inserting holes is formed with a guiding slope.

7. The crimp crystal head of claim 1, wherein the fixing seat is formed with a connecting trough for being inserted by the circuit board, and the connecting trough communicates with the terminal trenches.

8. The crimp crystal head of claim 1, wherein an end of the circuit board is formed with connecting holes, an end of the golden plate is provided with a connecting bar inserted into the connecting hole, and both the connecting bar and the connecting hole are an interference fit.

9. The crimp crystal head of claim 8, wherein the connecting bar is formed with a flexible hole.

10. The crimp crystal head of claim 1, further comprising a metal shielding case covering both the fixing seat and the base, an outside of the base is formed with a recess for receiving the metal shielding case.

* * * * *